US007578704B2

(12) United States Patent
Yang et al.

(10) Patent No.: US 7,578,704 B2
(45) Date of Patent: Aug. 25, 2009

(54) ELECTRICAL ADAPTER HAVING GROUNDING MEANS

(75) Inventors: Sheng-Ho Yang, Tu-cheng (TW); Tsu-Yang Wu, Tu-cheng (TW); Chun-Chieh Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/290,079

(22) Filed: Oct. 27, 2008

(65) Prior Publication Data

US 2009/0111328 A1 Apr. 30, 2009

(30) Foreign Application Priority Data

Oct. 26, 2007 (TW) ..... 96218028

(51) Int. Cl.
*H01R 25/00* (2006.01)

(52) U.S. Cl. ..... 439/638; 439/654; 439/108

(58) Field of Classification Search ..... 439/638, 439/654, 108, 567
See application file for complete search history.

(56) References Cited

U.S. PATENT DOCUMENTS 4,592,614 A * 6/1986 Myers, Jr. ..... 439/404
4,781,625 A * 11/1988 Yang ..... 439/654
5,547,385 A 8/1996 Spangler
6,454,599 B1 9/2002 Wu
6,733,307 B2 5/2004 Wu
6,887,108 B2 5/2005 Wu
7,497,739 B2 * 3/2009 Zhang et al. ..... 439/638

OTHER PUBLICATIONS

U.S. Appl. No. 11/810,814, not published, Hon Hai.

* cited by examiner

*Primary Examiner*—Tho D Ta
(74) *Attorney, Agent, or Firm*—Wei Te Chung

(57) ABSTRACT

An electrical adapter comprises a first mating portion adapted for engaging a first type interface complement connector, a second mating portion adapted for engaging a second type interface complement connector, a mounting plane adapted for being set on a printed circuit board, and grounding means. The first mating portion defines a pair of first guiding rails. The second mating portion defines a pair of second guiding rails. The grounding means comprises a first contacting arm extending to said first guiding rail, a second contacting arm extending toward said second guiding rail, and a leg extending to said mounting plane, establishing a grounding path from said first mating portion and second mating portion to a printed circuit board.

20 Claims, 6 Drawing Sheets

ELECTRICAL ADAPTER HAVING GROUNDING MEANS

BACKGROUND OF THE INVENTION

1. Field of the Invention

The present invention is generally related to the art of electrical adapters for connectors, and more particularly to an electrical adapter having grounding means having two contacting portions establishing a grounding path from two mating portions to a printed circuit board.

2. Description of Related Art

In the recent years, single connector attachment (SCA) becomes a popular connection interface. The SCA interface was designed to provide a standard connection for system and was followed by a second version called the SCA2. Unless otherwise specified, the use of the term of SCA2 here includes both original SCA as well as its descendant, the SCA2. Generally, an SCA2 receptacle connector is mounted on a fibre channel backplane in the computer and an SCA2 plug connector is connected to a hard drive which is adapted to be attached to the fibre channel backplane for establishing signal transmission between the hard drive and the fibre channel backplane through the interconnection of such SCA2 receptacle and plug connectors.

U.S. Pat. No. 6,887,108 issued to Wu on May 3, 2005, discloses an electrical adapter (10) adapted for interconnecting a SCA2 interface with a serial ATA interface, includes a serial advanced technology attachment (serial ATA) receptacle connector (20), a single connector attachment 2 (SCA2) plug connector (30), a printed circuit board (40) and a pair of covers (50). The serial ATA receptacle connector (20) and the SCA2 plug connector (30) are respectively electrically and mechanically connected to the printed circuit board (40). The printed circuit board (40) performs the functions of signal transmission and conversion between the serial ATA receptacle connector (20) and the SCA2 plug connector (30). The serial ATA receptacle connector (20) comprises a pair of first board locks (27) each defining a pair of resilient legs (270) adapted for inserting into a receiving hole (460) in the printed circuit board (40). The SCA2 plug connector (30) comprises a pair of second board locks (33) each defining a pair of resilient legs (334) adapted for inserting into a receiving hole (460) in the printed circuit board (40). The SCA2 plug connector (30), as shown in FIGS. 5-6 in Wu's patent, a pair of alignment posts (36) is disposed at opposite ends of the second base (34), each of which defines a channel (360) for receiving a first portion (330) of a corresponding board lock (33) and partially exposed on the outer side providing a grounding path for the complementary connector (not shown). The serial ATA receptacle connector (20), as shown in FIG. 4 in Wu's patent, the pair of board locks (27) are embedded in the housing providing no grounding path for the complementary connector (not shown).

Hence, an improved electrical adapter is required to overcome the disadvantages of the prior art.

SUMMARY OF THE INVENTION

Accordingly, an object of the present invention is to provide an electrical adapter having grounding means having two contacting portion establishing a grounding path from two mating portions to a printed circuit board.

In order to achieve the above-mentioned object, an electrical adapter comprises a first mating portion adapted for engaging a first type interface complement connector, a second mating portion adapted for engaging a second type interface complement connector, a mounting plane adapted for being set on a printed circuit board, and grounding means. The first mating portion defines a pair of first guiding rails. The second mating portion defines a pair of second guiding rails. The grounding means comprises a first contacting arm extending to said first guiding rail, a second contacting arm extending toward said second guiding rail, and a leg extending to said mounting plane, establishing a grounding path from said first mating portion and second mating portion to a printed circuit board.

Other objects, advantages and novel features of the present invention will become more apparent from the following detailed description of the present embodiment when taken in conjunction with the accompanying drawings.

BRIEF DESCRIPTION OF THE DRAWINGS

FIG. 3 is an assembled, perspective view of the electrical adapter as shown in FIG. 1 and a printed circuit board adapted for the electrical adapter to mount on;

DETAILED DESCRIPTION OF THE INVENTION

Figure 1:
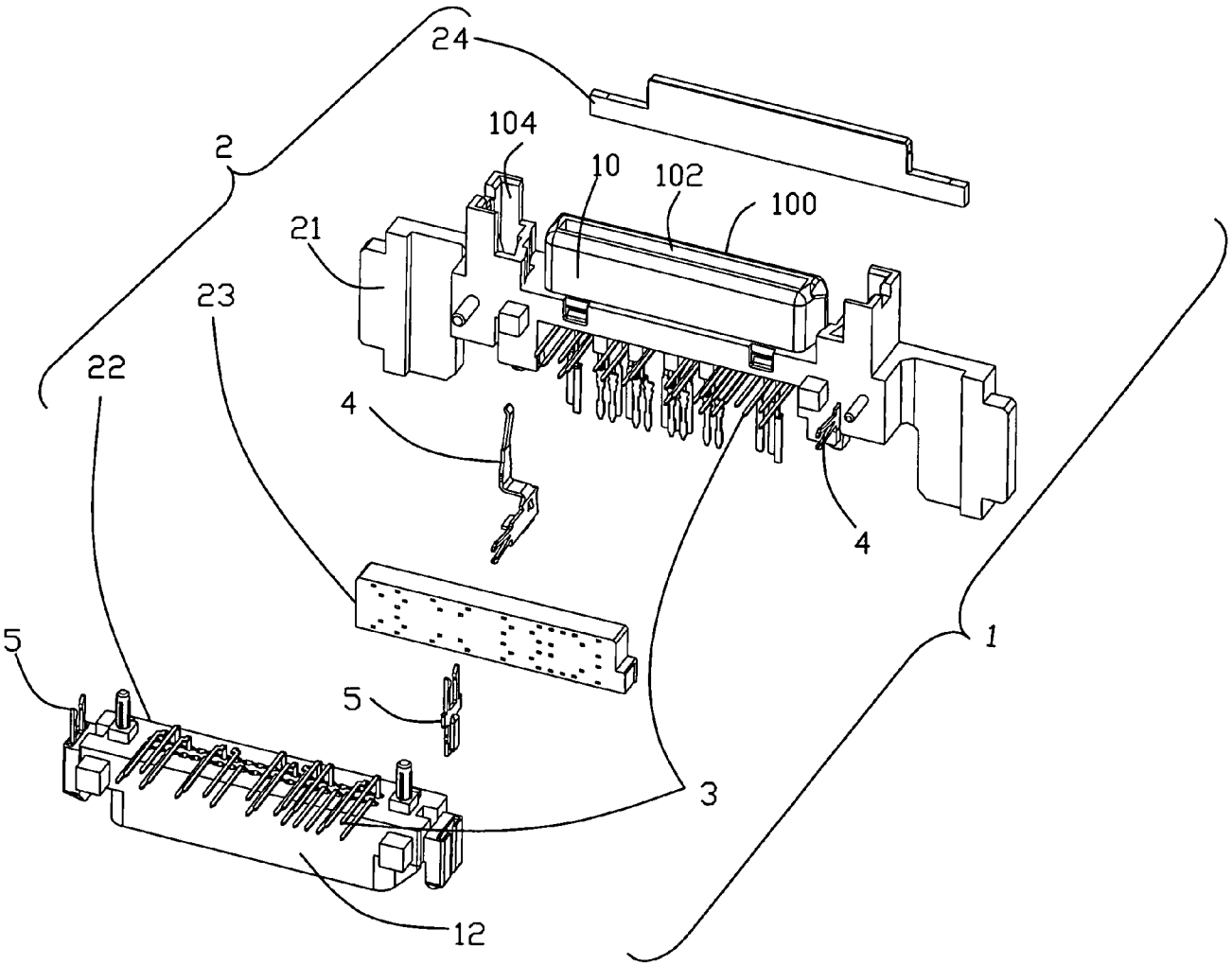
FIG. 1 is an exploded, perspective view of an electrical adapter of a preferred embodiment of the present invention.
Figure 2:
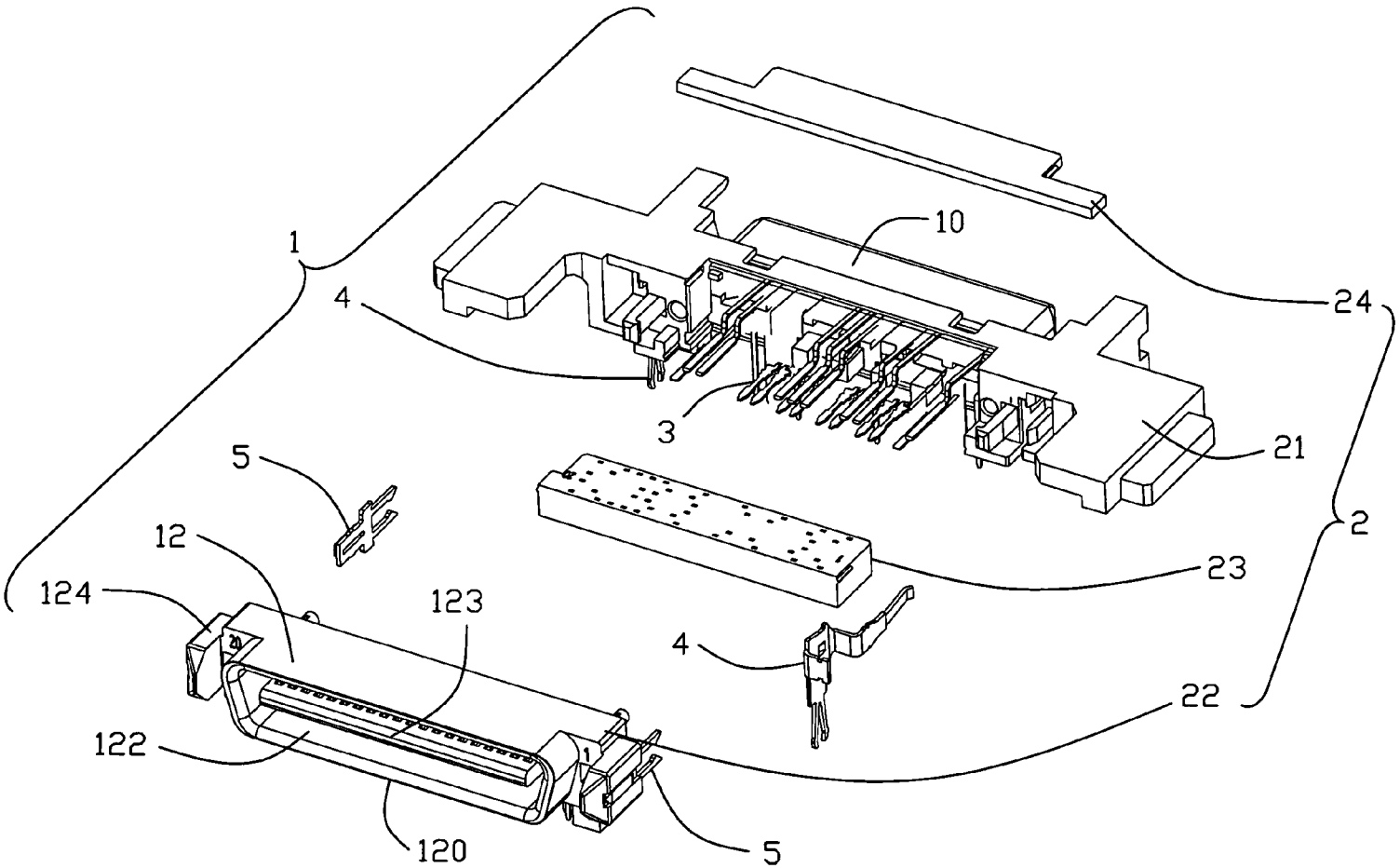
FIG. 2 is an exploded, perspective view of the electrical adapter as shown in FIG. 1, view from another direction.
Figure 3:
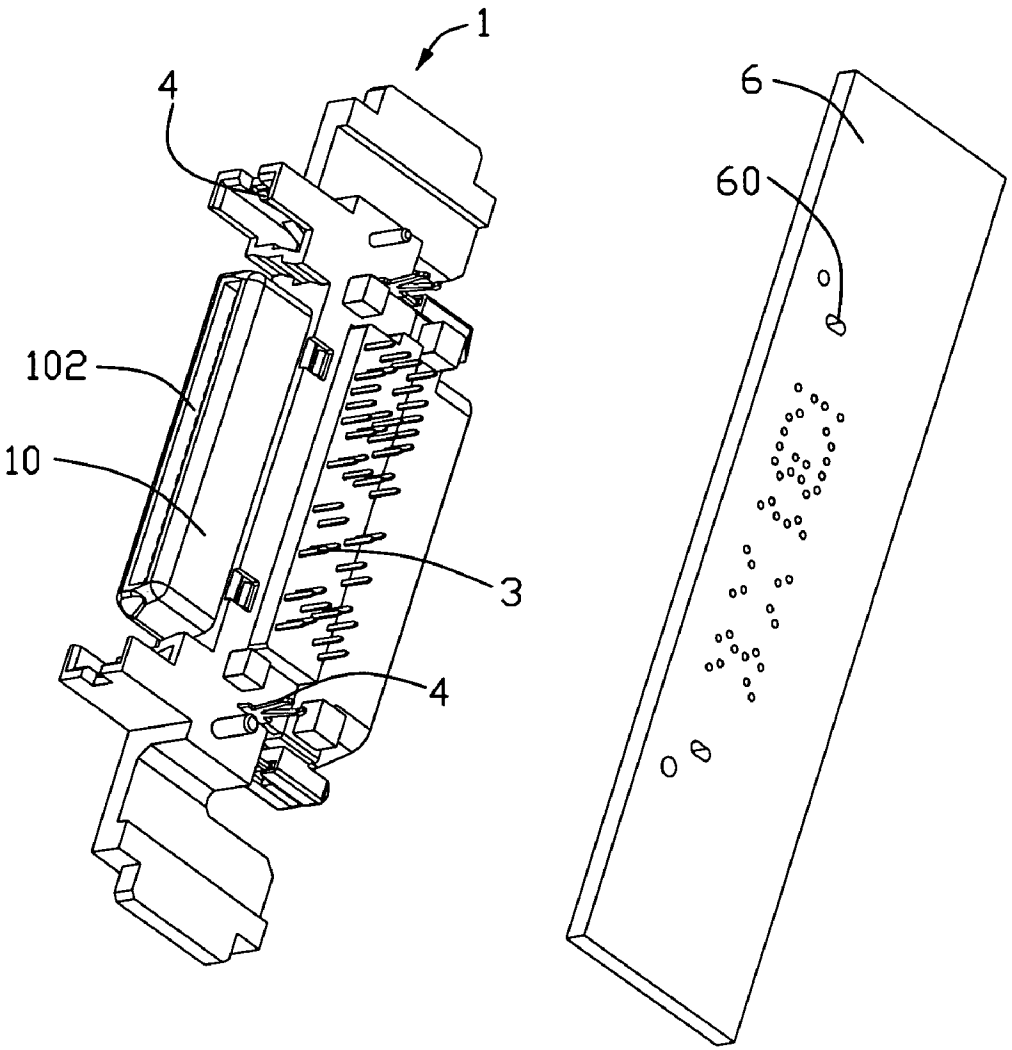

Reference will now be made in detail to the preferred embodiment of the present invention.

Referring to FIGS. 1-6, an embodiment of the present invention illustrated. An electrical adapter 1 defining a first mating portion 10, a second mating portion 12, and a mounting plane 14 adapted for being set on a printed circuit board 6. The electrical adapter 1 comprises dielectric housing 2, a plurality of conductive contacts 3, a pair of grounding means 4, and a pair of junction pieces 5.

The dielectric housing 2 comprises a first housing 21, a second housing 22, a spacer 23, and a cover 24. The first housing 21 constructs the main portion of the first mating portion 10, the second housing 22 constructs the main portion of the second mating portion 12, and the spacer 23 retains the tail of the conductive contacts 3 to a specific position, while the cover 24 seals the space left between the first housing 21 and the second housing 22. The conductive contacts 3 are totally maintain in proper position after the first housing 21, the second housing 22, the spacer 23, and the cover 24 are assembled together.

Figure 4:
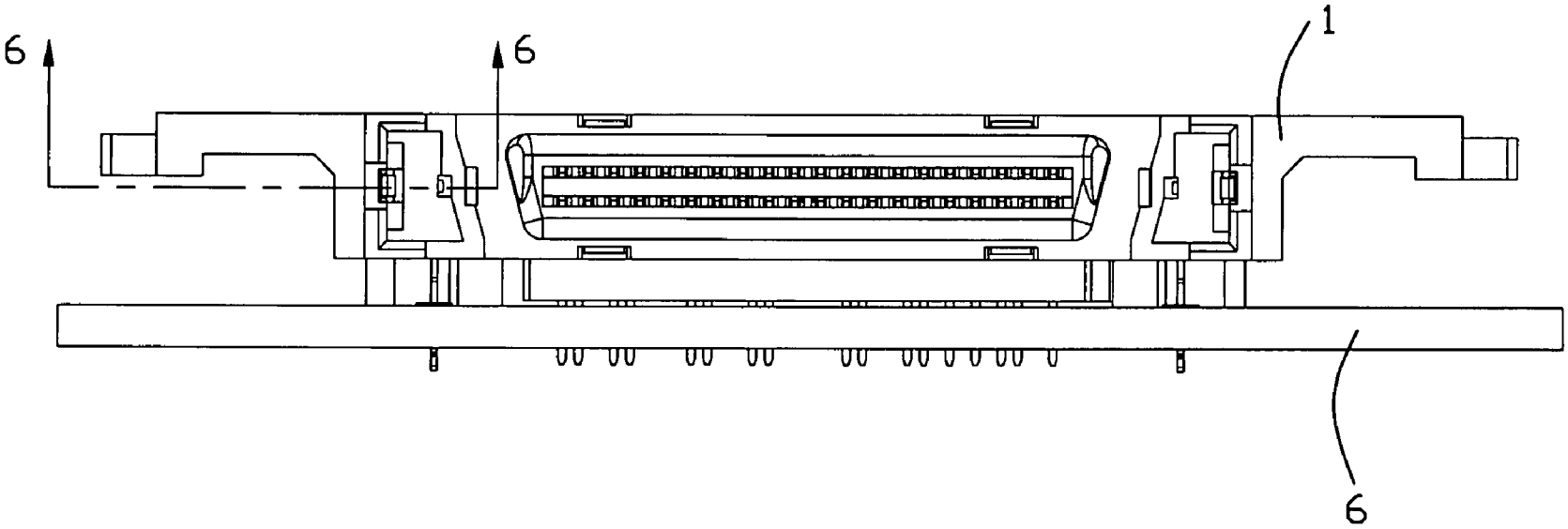
FIG. 4 is an assembled, front plane view of the electrical adapter and printed circuit board as shown in FIG. 3.

The first mating portion 10 having a first mating face 100 adapted for engaging a first type interface complement connector (not shown) along a first direction. The second mating portion 12 having a second mating face 120 adapted for engaging a second type interface complement connector (not shown) along a second direction opposing to the first direction. The first direction and the second direction are parallel to the mounting plane (not labeled). The electrical adapter 1 is elongate, as shown in FIG. 4, and has a low profile outline when mounted on the printed circuit board 6.

The first housing 21 defining a pair of first guiding rails 104 at opposing elongate ends giving a blind mating feature for coupling with a complementary connector (not shown), a D-shaped port 102 between the pair of first guiding rails 104 having a slot 102 defining a pair of opposing inner walls (not labeled) therein. The first guiding rails 104 respectively define a groove (not labeled) having a opening facing each other and extending along the first direction.

The second housing 22 defining a pair of second guiding rails 124 at opposing elongate ends giving a blind mating feature for coupling with a complementary connector (not shown), a D-shaped port 122 between the pair of second guiding rails 124 having a tongue board 123 defining a pair of opposing engaging faces (not labeled) thereon. The second guiding rails 124 respectively define a groove (not labeled) communicating an outer side.

Some conductive contacts 3 partially exposed on the inner walls of the slot 102 adapted for electrically connecting contacts on a complementary connector (not shown), some conductive contacts 3 partially exposed on the engaging faces of the tongue board 123 adapted for electrically connecting contacts on a complementary connector (not shown). A part of the conductive contacts 3 respectively extend to the second mating portion 12 from the first mating portion 10, another part of the conductive contacts 3 each has a tail extending downwardly to the mounting plane (not labeled) from the first mating portion 10 or from the second mating portion 12.

Figure 5:
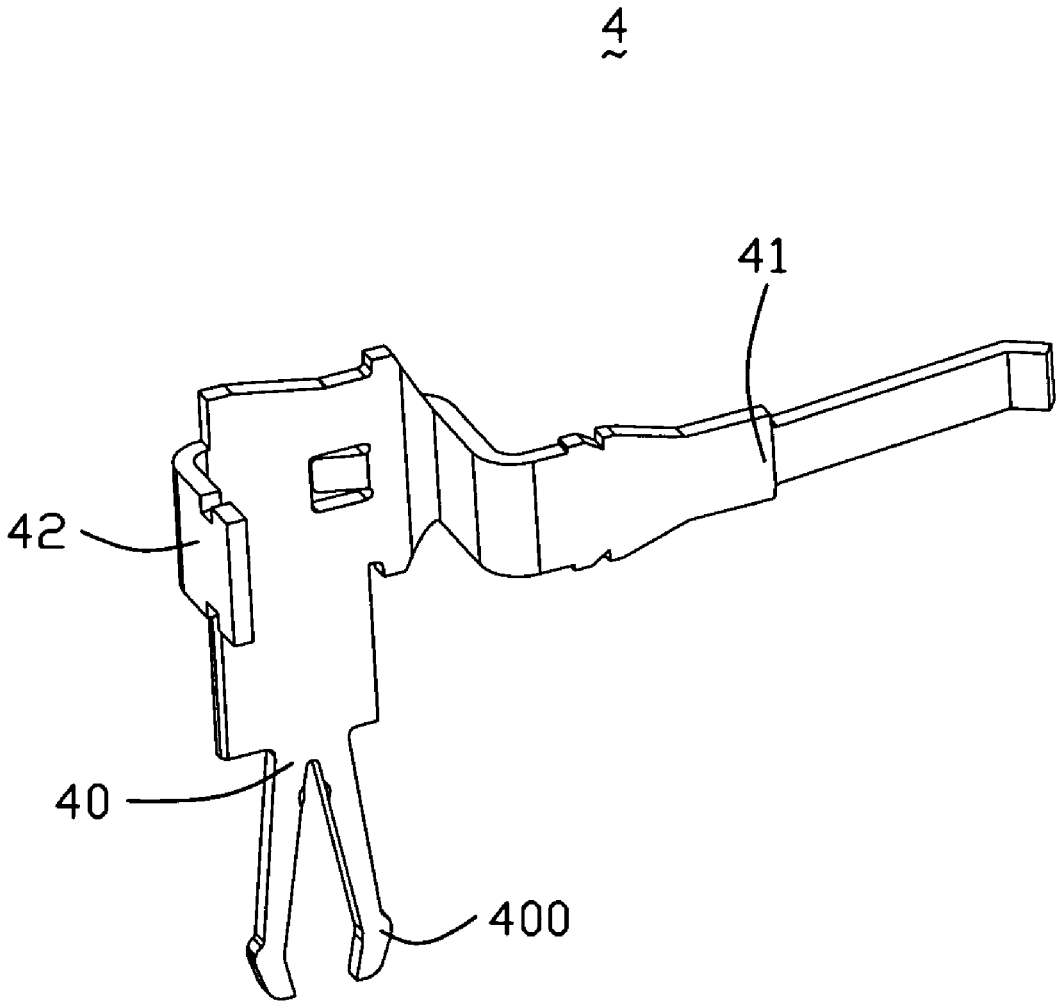
FIG. 5 is a perspective view of grounding means of the electrical adapter as shown in FIG. 1.
Figure 6:
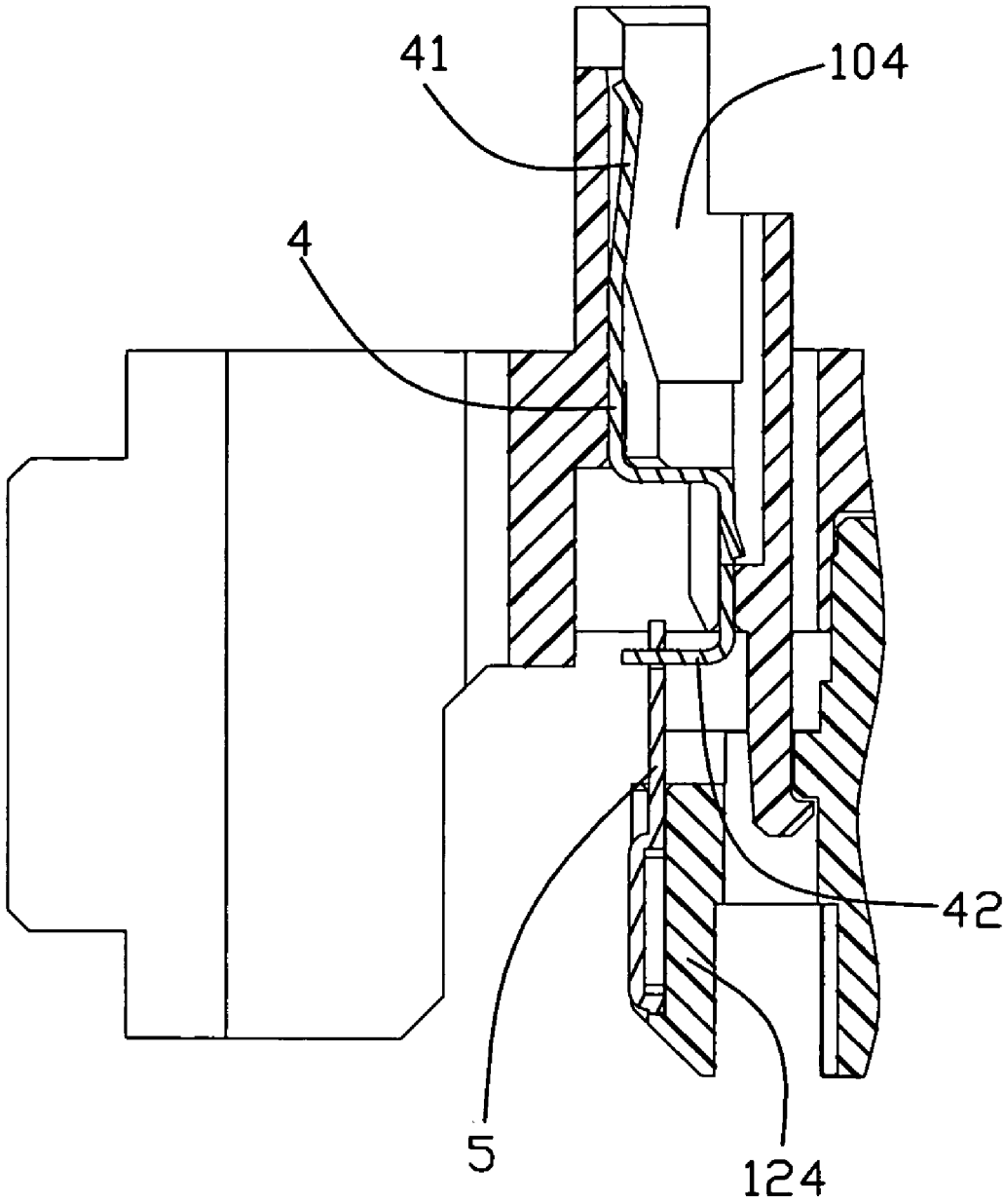
FIG. 6 is a detail sectional view showing grounding means of the electrical adapter taken on line 6-6 of FIG. 4.

Specially referring to FIG. 5 in conjunction, the grounding means 4 are stamped from a metal sheet adapted for establishing a grounding path from the first mating portion 10 and second mating portion 12 to a printed circuit board 6. Each grounding means 4 comprises a leg 40, a first contacting arm 41, and a transverse second contacting arm 42. The first contacting arm 41 extends into the groove (not labeled) of first guiding rail 104 and having a contacting face toward a middle portion of the electrical adapter 1. The second contacting arm 42 extends out from a side (not labeled) toward the second guiding rail 124 bent to extend in a plane perpendicular the second direction. The leg 40 extends downwardly to the mounting plane (not labeled) having a pair of locking portion 400 adapted for grasp a through hole 60 in a printed circuit board 6 on which the electrical adapter 1 mounted.

The junction pieces 5 are respectively secured in the groove of the second guiding rails 124. Each junction pieces 5 provides a contacting section (not labeled) exposed on the groove (not labeled) communicating the outer side of the second guiding rail 124, and a fork (not labeled) extending along the second direction and straddling on the second contacting arm 42 of the grounding means 4 and establishing electrical connection therebetween.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical adapter comprising:

a first mating portion, adapted for engaging a first type interface complement connector, defining a pair of first guiding rails;

a second mating portion, adapted for engaging a second type interface complement connector, defining a pair of second guiding rails;

a mounting plane adapted for being set on a printed circuit board;

grounding means comprising a first contacting arm extending to said first guiding rail, a second contacting arm extending toward said second guiding rail, and a leg extending to said mounting plane, establishing a grounding path from said first mating portion and second mating portion to a printed circuit board.

2. The electrical adapter as described in claim 1, wherein said first guiding rails respectively define a groove facing each other, said first contacting arm of said grounding means extending in said groove and having a contacting face toward a middle portion of the electrical adapter.

3. The electrical adapter as described in claim 2, wherein said second guiding rails respectively define a groove in an outer side, a junction piece is secured in said groove and electrically engaging with said second contacting arm of said grounding means.

4. The electrical adapter as described in claim 3, wherein said leg of grounding means has a pair of locking portion adapted for grasp a through hole in a printed circuit board on which the electrical adapter mounted.

5. The electrical adapter as described in claim 4, wherein said first mating portion can mate with a complementary connector along a first direction, the second mating portion can mate with a complementary connector along a second direction opposing to said first direction, the first direction and the second direction are parallel to said mounting plane.

6. The electrical adapter as described in claim 5, wherein said first mating portion defining a D-shaped port between said pair of first guiding rails, a slot having a pair of opposing inner walls in the D-shaped port, and a plurality of first conductive contacts exposed on said inner walls of said slot.

7. The electrical adapter as described in claim 6, wherein said second mating portion defining a D-shaped port between said pair of second guiding rails, a tongue board having a pair of opposing engaging faces in the D-shaped port, and a plurality of second conductive contacts exposed on said engaging faces.

8. The electrical adapter as described in claim 7, wherein a part of said first conductive contacts respectively having a tail extend to said mounting plane, another part of said first conductive contacts are respectively directly joined with one of said second conductive contacts.

9. An electrical adapter comprising:

a first mating portion, adapted for engaging a first type interface complement connector along a first direction, comprising elongate a first housing defining a pair of first guiding rails at opposing elongate ends;

a second mating portion, adapted for engaging a second type interface complement connector along a second direction, comprising a second housing defining a pair of second guiding rails at opposing elongate ends;

a mounting plane adapted for being set on a printed circuit board;

grounding means comprising a first contacting arm extending to said first guiding rail, a transverse second contacting arm on a side toward said second guiding rail, and a leg extending to said mounting plane, establishing a grounding path from said first mating portion and second mating portion to a printed circuit board; and a junction piece secured in said second guiding rail comprising a contacting section exposed on an outer side of said second guiding rail, and a fork straddling on said second contacting arm of said grounding means and establishing electrical connection therebetween.

10. The electrical adapter as described in claim 9, wherein said first guiding rails respectively define a groove facing each other, said first contacting arm of said grounding means extending in said groove and having a contacting face toward a middle portion of the electrical adapter.

11. The electrical adapter as described in claim 10, wherein said second guiding rails respectively define a groove communicating an outer side, said junction piece is secured in each said groove.

12. The electrical adapter as described in claim 11, wherein said leg of grounding means has a pair of locking portion adapted for grasp a through hole in a printed circuit board on which the electrical adapter mounted.

13. The electrical adapter as described in claim 12, wherein said first direction and the second direction are parallel to said mounting plane and opposing to each other.

14. The electrical adapter as described in claim 13, wherein said first mating portion defining a D-shaped port between said pair of first guiding rails, a slot having a pair of opposing inner walls in the D-shaped port, and a plurality of first conductive contacts exposed on said inner walls of said slot.

15. The electrical adapter as described in claim 14, wherein said second mating portion defining a D-shaped port between said pair of second guiding rails, a tongue board having a pair of opposing engaging faces in the D-shaped port, and a plurality of second conductive contacts exposed on said engaging faces.

16. The electrical adapter as described in claim 15, wherein a part of said first conductive contacts respectively having a tail extend to said mounting plane, another part of said first conductive contacts are respectively directly joined with one of said second conductive contacts.

17. An electrical adaptor for use with a printed circuit board, comprising:

a first mating port facing to an exterior in a first direction;

a second mating port facing to the exterior in a second direction opposite to the first direction;

a plurality of first contacts each having a first contacting portion exposed in the first mating port and a first mounting section for mounting to the printed circuit board;

a plurality of second contacts each having a second contacting portion exposed in the second mating port and a second mounting section for mounting to the printed circuit board;

a first grounding device associatively located beside the first mating port;

a second grounding device associatively located beside the second mating port; wherein said first grounding device and said second grounding device engage with each other under condition that at least one of said first grounding device and said second grounding device defines a mounting leg for mounting to said printed circuit board.

18. The electrical adaptor as claimed in claim 17, wherein said mounting leg extends in a third direction perpendicular to said first and second directions.

19. The electrical adaptor as claimed in claim 17, further including a plurality of third contacts each having the first contacting section extending into the first mating port and a second contacting section extending into the second mating port.

20. The electrical adaptor as claimed in claim 17, wherein said first grounding device has a first mating section configured to mate with a first grounding part belonging to a first complementary connector which is adapted to be coupled to the first mating port, and said second grounding device has a second mating section configured to mate with a second grounding part belonging to a second complementary connector which is adapted to be coupled to the second mating port.

* * * * *